United States Patent [19]

Goldmunz et al.

[11] Patent Number: 4,729,647

[45] Date of Patent: Mar. 8, 1988

[54] RETROFIT OPTICAL TURRET WITH LASER SOURCE

[75] Inventors: Menachem M. Goldmunz, Jerusalem; Michael L. Neugarten, Ramat Efal; Yonatan Gerlitz, Herzlia, all of Israel

[73] Assignee: Israel Aircraft Industries Ltd., Lod, Israel

[21] Appl. No.: 895,707

[22] Filed: Aug. 12, 1986

[30] Foreign Application Priority Data

Sep. 9, 1985 [IL] Israel ..... 76343

[51] Int. Cl.[4] ..... G02B 23/04; G02B 23/10; G02B 27/64

[52] U.S. Cl. ..... 350/537; 350/567; 350/569; 350/572; 350/171; 350/500

[58] Field of Search ..... 350/537–545, 350/557, 561, 562, 566, 569, 567, 572, 500

[56] References Cited

U.S. PATENT DOCUMENTS 3,918,813 11/1975 Rossiter ..... 350/539
4,108,551 8/1978 Weber ..... 350/622
4,475,793 10/1984 Ford ..... 350/172
4,626,905 12/1986 Schmidt ..... 350/538

*Primary Examiner*—Jon W. Henry
*Attorney, Agent, or Firm*—Saidman, Sterne, Kessler & Goldstein

[57] ABSTRACT

A retrofitted optical sight cluster system including a turret support structure defining a lower turret area and upper turret area sealed from the lower turret area, optics mounted onto the turret support structure including a gimbal mounted optics assembly for providing an image of an outside scene viewed through a window and a relay optics assembly fixedly mounted on the turret support structure for transmitting that image in a first direction along an optical path extending through the upper turret area to an operator's eye, a laser source mounted in the upper turret area, and apparatus for diverting the radiation output of the laser source so as to pass along the optical path from the upper turret area to the lower turret area in a second direction opposite to the first direction.

12 Claims, 9 Drawing Figures

RETROFIT OPTICAL TURRET WITH LASER SOURCE

FIELD OF THE INVENTION

The present invention relates to fire control systems generally and more particularly to optical sight apparatus for helicopters.

BACKGROUND OF THE INVENTION

Conventional helicopter fire control systems employ optical sighting apparatus for use by the helicopter gunner. In recent years laser rangefinders and designators have been developed to aid the gunner in target acquisition and weapons delivery.

Much effort has been expended in attempting to retrofit existing fire control systems to accomodate laser rangefinders and designators. The presently proposed solutions require major structural changes to the helicopter turret and substantial reengineering of the fire control optics, all at significant cost.

Specifically, reference is made to the existing M-65 optical sight cluster system manufactured by Hughes Aircraft Company which is commonly referred to as a TSU (Turret Sighting Unit). An optical schematic of this system, superimposed on the upper turret support, appears in FIG. 1. It has been proposed to incorporate the laser rangefinder and/or designator in the lower part of the system on the gimballed part of the optics.

SUMMARY OF THE INVENTION

The present invention seeks to provide a retrofit structure for a helicopter fire control system which does not require structural changes to the radius of the helicopter turret and its support and involves little if any changes to the fire control optics.

There is thus provided in accordance with a preferred embodiment of the present invention, a retrofitted optical sight cluster system including a turret support structure defining a lower turret area and upper turret area sealed from the lower turret area, optics mounted onto the turret support structure including a gimbal mounted optics assembly for providing an image of an outside scene viewed through a window and a relay optics assembly fixedly mounted on the turret support structure for transmitting that image in a first direction along an optical path extending through the upper turret area to an operator's eye, a laser source mounted in the upper turret area, and apparatus for diverting the radiation output of the laser source so as to pass along the optical path from the upper turret area to the lower turret area in a second direction opposite to the first direction.

According to an embodiment of the invention the radiation output of the laser source passes along the optical path, departs therefrom and then rejoins it, passing through the narrow field of view objective.

According to an embodiment of the invention, an optical element of negative power is provided off axis so as to intercept the laser radiation prior to its entering the optical path.

In accordance with an alternative embodiment of the present invention, a holographic element having negative power only for the laser radiation is interposed along the optical path.

The invention has a number of significant advantages. It avoids heat dissipation in the lower turret area wherein cooling is difficult due to the sensitive nature of the components located therein. It avoids structural changes to the turret. It does not involve additional loading of the gimbals. Furthermore it allows for the possibility of inflight boresight between the laser and the Direct View Optics/Goniometer with the use of the existing boresight system. The laser can be maintained without opening the lower turret area. Additionally the apparatus situated in the lower turret area is shielded from the electromagnetic and radio frequency interference produced by the laser.

BRIEF DESCRIPTION OF THE DRAWINGS

The present invention will be understood and appreciated more fully from the following detailed description taken in conjunction with the drawings in which.

DETAILED DESCRIPTION OF A PREFERRED EMBODIMENT

Figure 2A:
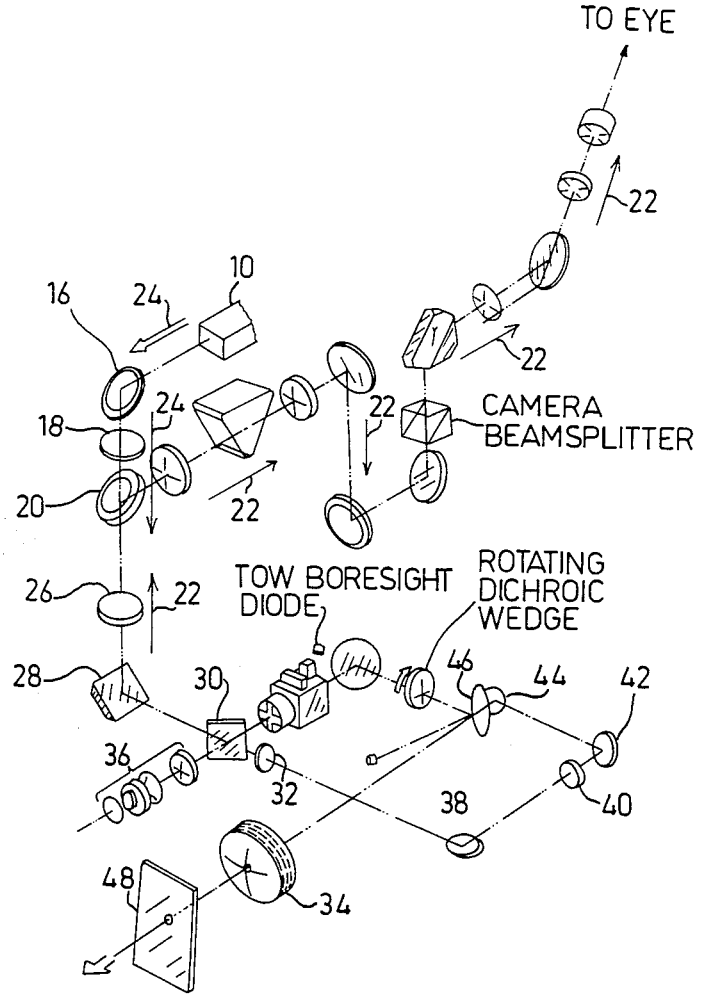
FIG. 2A is an optical schematic illustration of a retrofitted TSU cluster according to one preferred embodiment of the present invention.
Figure 2B:
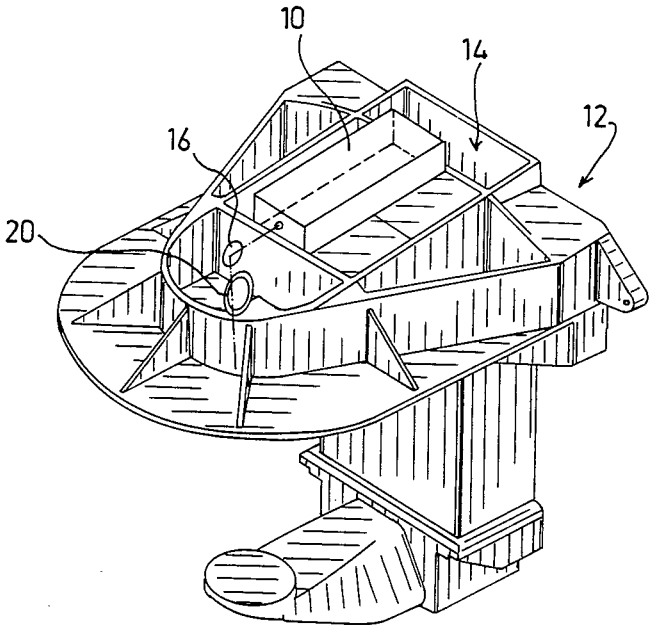
FIG. 2B is an optical schematic illustration of a part of the retrofitted TSU cluster of FIG. 2A superimposed on the upper turret support structure.

Reference is made to FIGS. 2A and 2B, which illustrate one preferred embodiment of the invention. According to this embodiment, a laser source 10, such as a laser designator or laser rangefinder such as those manufactured by Israel Electro-Optical Industry of Rehovot, Israel, including an NdYAG laser emitting at 1.06 microns, at 90 millijoule with a pulse length of 20 nanoseconds, is mounted onto the upper turret structure 12 in the upper turret area 14 underlying a cover member (not shown), which can be removed to provide ready access to the laser source. The radiation output beam of the laser source 10 is deflected by a folding element 16, such as a suitable mirror or prism, so as to pass through an optical element 18.

The optical element 18 may comprise one or more lenses having surfaces which can be concave, flat or convex. According to an alternative embodiment of the invention, optical element 18 may be located between the laser source 10 and folding element 16 rather than as shown. As a further alternative, the optical element 18 may have two portions, one of which is located as illustrated, i.e. downstream of the folding element 16 and a second portion of which is located between the laser source 10 and folding element 16.

The laser radiation beam then impinges upon a dichroic mirror 20, which is operative to reflect radiation in the visible spectrum which passes along the optical path in the opposite direction to that of the laser radiation and permits the laser radiation beam to pass therethrough, generally unattenuated. It is noted that in the prior art system illustrated in FIG. 1, the corresponding element is a conventional fold mirror having somewhat different mounting.

Figure 1:
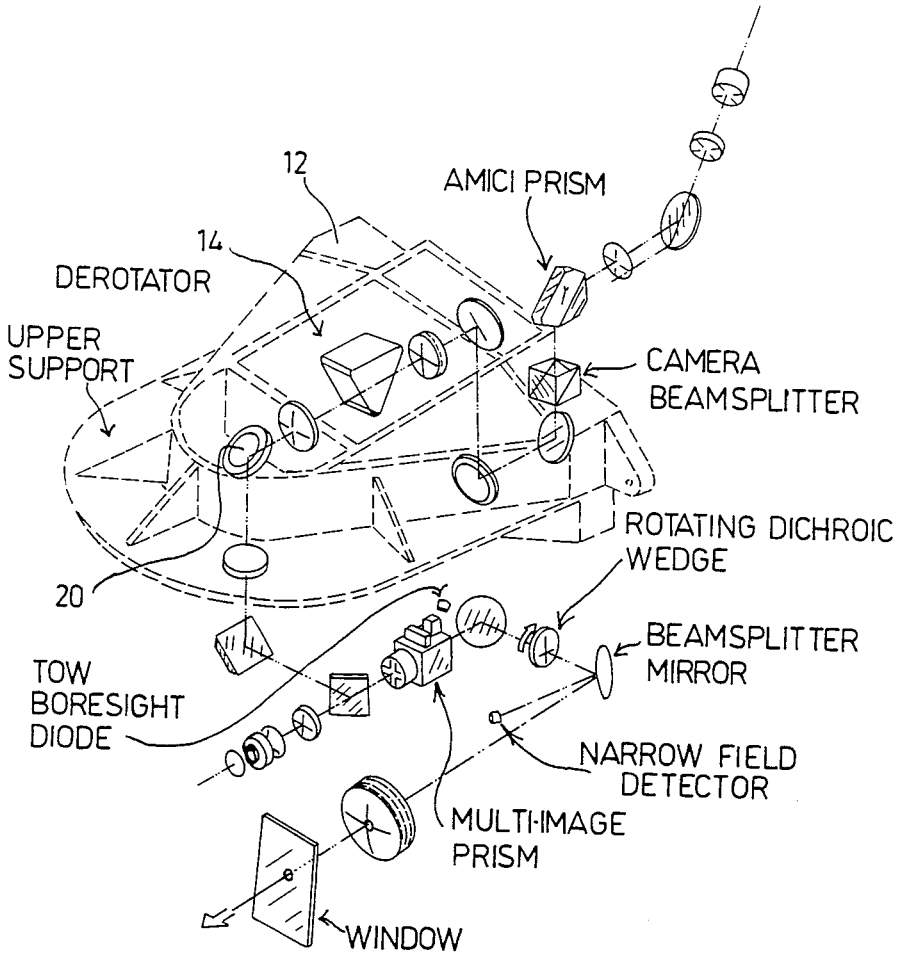
FIG 1 PRIOR ART
FIG. 1 is an optical schematic illustration of a prior art TSU cluster superimposed on the turret support structure.

The optical assembly to the right of dichroic mirror 20 is essentially identical to that of the prior art system illustrated in FIG. 1 and will not be described herein, other than to note the general direction of the light of interest towards the eye of the operator, as indicated by arrows 22. The laser radiation, which travels in an opposite direction indicated by arrows 24, next passes through an optical element 26, which is a relay lens of the same general type as that incorporated in the prior art device but having coating and surface quality designed to enable the passage therethrough of laser energy of the desired power level.

After passing through optical element 26, the laser radiation is bent by a mirror 28, which is also adapted for the laser radiation, and by a flip-flop mirror 30 which provides a selective field of view for the system. Mirror 30 is here configured as a dichroic mirror permitting the passage therethrough of the laser radiation from source 10 and suitable mounting structures are provided.

At this point, the laser radiation leaves the prior art optical path and passes through a negative optical element 32, which is preferably positioned in or near a wall which divides the narrow field of view objective 34 from the wide field of view objective 36. The optical element 32 may comprise one or more lenses having surfaces which can be concave, flat or convex. Alternatively, it may be omitted.

From optical element 32, the laser radiation beam crosses the narrow field of view light pathway and is bent by a folding element 38, such as a mirror or prism and then passes through an optical element with negative power 40. The optical element 40 may comprise one or more lenses having surfaces which can be concave, flat or convex. The laser radiation is then bent by successive folding elements 42 and 44, which are typically mirrors or prisms. Alternatively, these two elements can be combined in a single folding element.

Adjacent folding element 44 is a dichroic mirror 46. The laser beam passes through dichroic mirror 46 which is operative to reflect all other radiation.

In an alternative embodiment element 40 may be located between elements 42 and 44 instead of as illustrated. Alternatively, element 40 may be replaced by a plurality of optical elements which may be located between elements 32 and 38, between elements 38 and 42 and between elements 44 and 46.

The laser radiation from source 10 passes from element 44 through the narrow field of view objective 34 and through a window 48 to the designated target. Elements 34 and 48 are designed to be suitable for passage therethrough of laser radiation of the requisite power.

A laser receiver, in the form of a detector, is located either at the location of laser source 10 or alternatively in the focal plane of objective 34.

Figure 8:
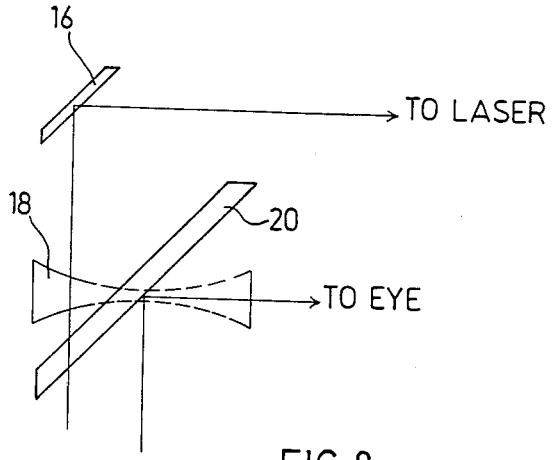
FIG. 8 is a side view illustration of a portion of the optical assembly shown in FIG. 3.
Figure 3:
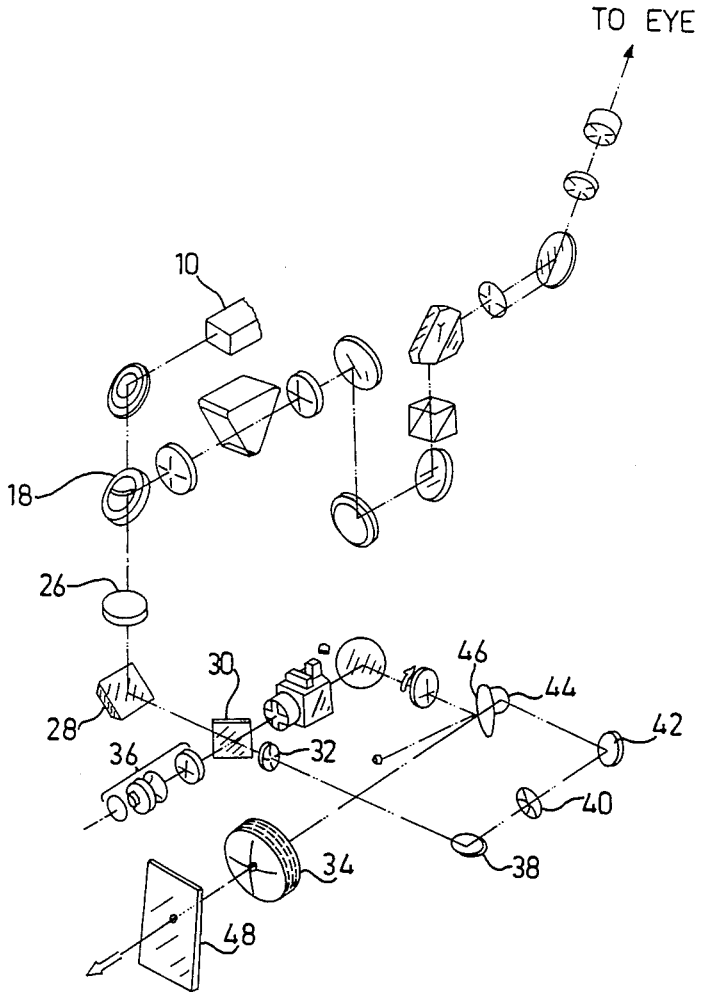
FIG. 3 is an optical schematic illustration of a retrofitted TSU cluster according to a second preferred embodiment of the present invention.

Referring now to FIG. 3, there is seen a second preferred embodiment of the invention which differs from the embodiment of FIGS. 2A and 2B in the arrangement and structure of elements 18 and 26. In this embodiment, element 18 has negative power. The optical element 18 may comprise one or more lenses having surfaces which can be concave, flat or convex. Optical element 18 is cut and located off axis to enable placement thereof as close to element 20 as possible, as illustrated in FIG. 8.

The remainder of this embodiment is essentially the same as in the embodiment of FIGS. 2A and 2B. This embodiment has the advantage that element 26 does not require modification from its construction according to the prior art.

Figure 4:
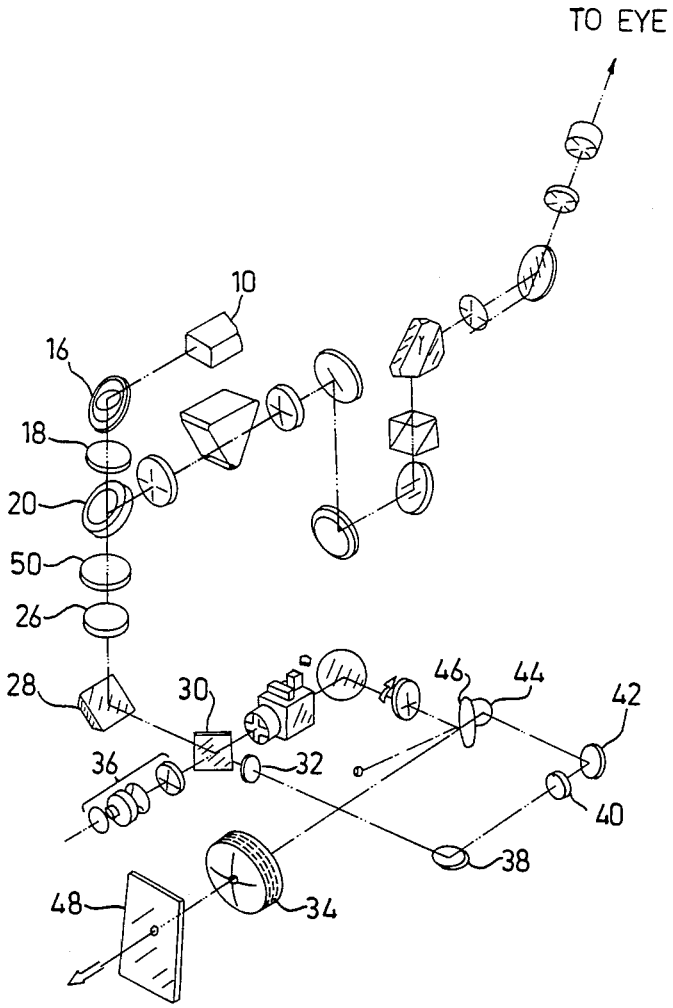
FIG. 4 is an optical schematic illustration of a retrofitted TSU cluster according to a third preferred embodiment of the present invention.

Reference is now made to FIG. 4, which illustrates another preferred embodiment of the invention. According to this embodiment a holographic element 50 is interposed between elements 20 and 26 to serve as a negative lens for the laser radiation only and has no power for any other wavelength so as not to degrade the performance of the optical sight system. The remainder of the system is essentially identical to that shown in FIGS. 2A and 2B, noting that here also, element 26 does not require modification.

Figure 5:
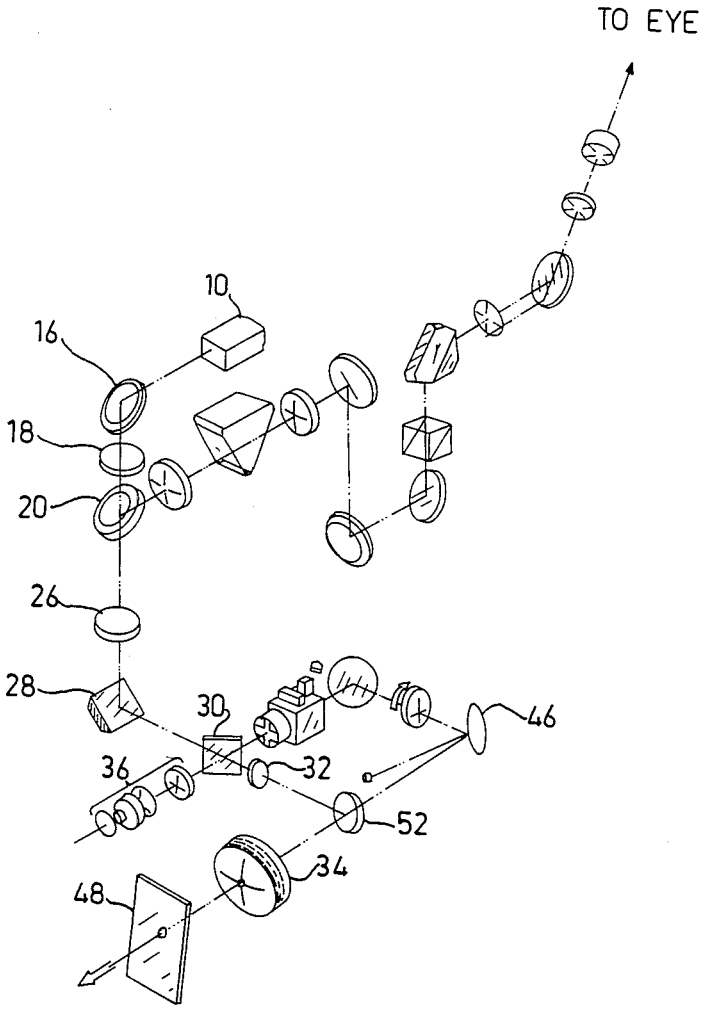
FIG. 5 is an optical schematic illustration of a retrofitted TSU cluster according to a fourth preferred embodiment of the present invention.

Reference is now made to FIG. 5, which illustrates yet another preferred embodiment of the invention. According to this embodiment, a dichroic mirror 52 is disposed in the existing optical path between optical elements 46 and 34. This mirror is operative to reflect almost all of the laser radiation received via optical element 32 and to direct it through the narrow field of view objective 34 and window 48. A small portion of the laser radiation, about 0.5% to 1%, passes through this mirror and may be directed to the laser receiver when located in the focal plane of the objective 34.

In the embodiment of FIG. 5, elements 38–44 are omitted. The remainder of the system is identical to that of FIGS. 2A and 2B. This embodiment is suitable for applications where relatively widely divergent laser beams are acceptable or where lasers with extremely narrow raw output beam divergences are employed.

Figure 6:
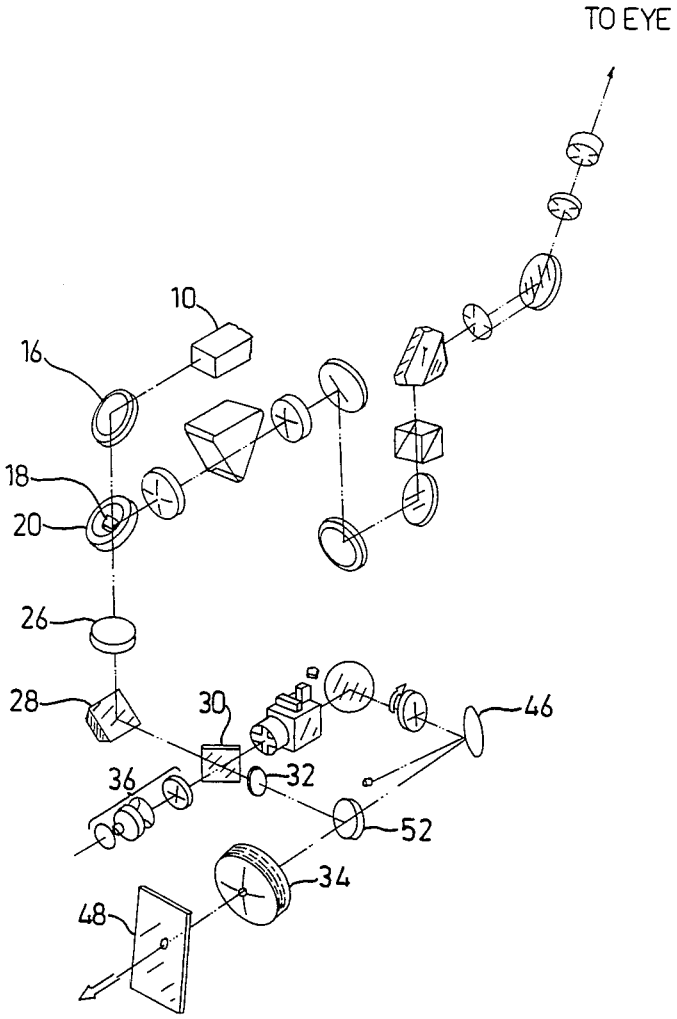
FIG. 6 is an optical schematic illustration of a retrofitted TSU cluster according to a fifth preferred embodiment of the present invention.

Reference is now made to FIG. 6, which illustrates a further alternative embodiment of the present invention, wherein elements 18 and 20 are configured as shown in FIG. 8, while the output end of the laser radiation optical pathway, including elements 46, 52, 34 and 48 is configured as shown in FIG. 5.

Figure 7:
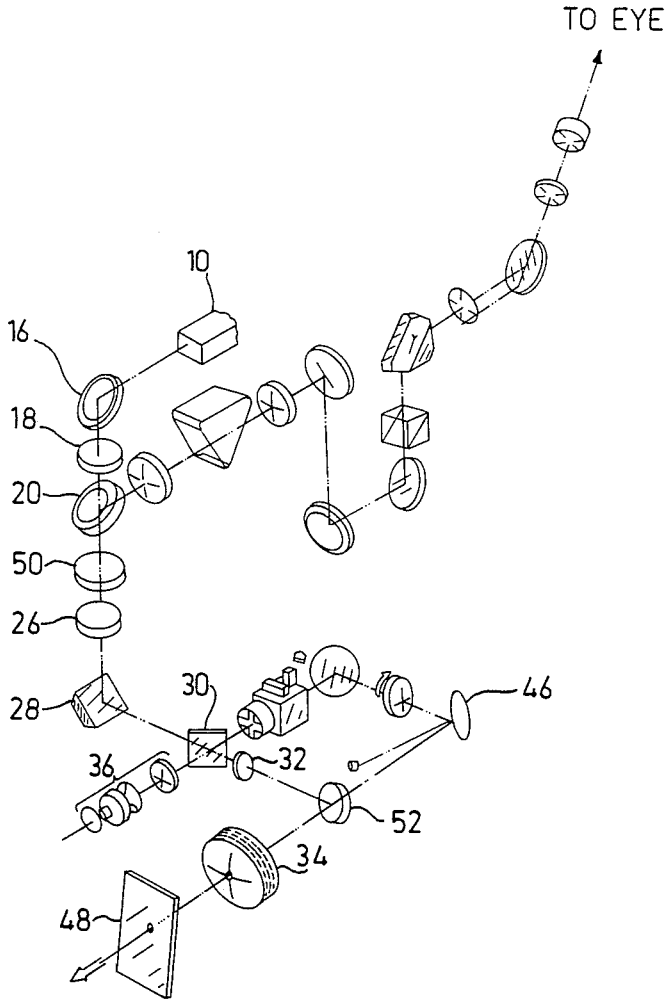
FIG. 7 is an optical schematic illustration of a retrofitted TSU cluster according to a sixth preferred embodiment of the present invention.

FIG. 7 illustrates yet another alternative embodiment of the present invention, wherein elements 10, 16, 18, 20, 50 and 26 are configured according to the embodiment of FIG. 4, while the output end of the laser radiation optical pathway, including elements 46, 52, 34 and 48 is configured as shown in FIG. 5.

It will be appreciated by persons skilled in the art that the present invention is not limited by what has been particularly shown and described hereinabove. Rather the scope of the present invention is defined only by the claims which follow.

We claim:

1. A retrofitted optical sight cluster system comprising:

a turret support structure defining a gimballed lower turret area and a fixed upper turret area sealed from the lower turret area;

optics mounted onto the turret support structure including a gimbal mounted optics assembly, including narrow field of view and wide field of view optics, for providing a stabilized image of an outside scene viewed through a window; and a relay optics assembly fixedly mounted on the turret support structure for transmitting said stabilized image in a first direction along an optical path extending through the upper turret area to an operator's eye;

a laser source mounted in said fixed upper turret area; and means for diverting the radiation output of said laser source so as to pass along at least a portion of said optical path from the fixed upper turret area to the gimballed lower turret area in a second direction opposite to the first direction.

2. A system according to claim 1 and wherein said optical path includes a narrow field of view objective and said means for diverting includes means for causing the radiation output of said laser source to pass through said narrow field of view objective.

3. A system according to claim 1 and wherein said means for diverting comprises an optical element of negative power located off axis with respect to said optical path so as to intercept the radiation output of said laser source prior to its entering said optical path.

4. A system according to claim 2 and wherein said means for diverting comprises an optical element of negative power located off axis with respect to said optical path so as to intercept the radiation output of said laser source prior to its entering said optical path.

5. A system according to claim 1 wherein said means for diverting comprises a holographic element of negative power only for the laser radiation disposed along the optical path.

6. A system according to claim 2 wherein said means for diverting comprises a holographic element of negative power only for the laser radiation disposed along the optical path.

7. A system according to claim 1 and wherein said optics mounted onto the turret support structure comprise a plurality of dichroic beam splitters arranged to have laser radiation pass therethrough and have other electromagnetic radiation reflect therefrom.

8. A retrofitted optical sight cluster system comprising:

a turret support structure defining a lower turret area and upper turret area sealed from the lower turret area;

optics mounted onto the turret support structure including a gimbal mounted optics assembly for providing an image of an outside scene viewed through a window; and a relay optics assembly fixedly mounted on the turret support structure for transmitting said image in a first direction along an optical path extending through the upper turret area to an operator's eye;

a laser source mounted in said upper turret area; and means for diverting the radiation output of said laser source so as to pass along at least a portion of said optical path from the upper turret area to the lower turret area in a second direction opposite to the first direction, said means for diverting including means for causing the radiation output of the laser source first to pass along said optical path, then to depart therefrom and finally to rejoin it.

9. A system according to claim 8 and wherein said optical path includes a narrow field of view objective and said means for diverting includes means for causing the radiation output of said laser source to pass through said narrow field of view objective.

10. A system according to claim 8 and wherein said means for diverting comprises an optical element of negative power located off axis with respect to said optical path so as to intercept the radiation output of said laser source prior to its entering said optical path.

11. A system according to claim 8 wherein said means for diverting comprises a holographic element of negative power only for the laser radiation disposed along the optical path.

12. A system according to claim 8 and wherein said optics mounted onto the turret support structure comprise a plurality of dichroic beam splitters arranged to have laser radiation pass therethrough and have other electromagnetic radiation reflect therefrom.

* * * * *